United States Patent [19]

Bakker et al.

[11] Patent Number: 4,623,602

[45] Date of Patent: Nov. 18, 1986

[54] MAGNETICALLY ATTRACTABLE COLOR TONER POWDER

[75] Inventors: Martin Bakker, Grubbenvorst; Johannes A. H. Van Laarhoven, Cuyk, both of Netherlands

[73] Assignee: Oce-Nederland B.V., Venlo, Netherlands

[21] Appl. No.: 702,666

[22] Filed: Feb. 19, 1985

[30] Foreign Application Priority Data

Feb. 29, 1984 [NL] Netherlands ..... 8400638

[51] Int. Cl.[4] ..... G03G 9/08; G03G 9/14

[52] U.S. Cl. ..... 430/106; 430/106.6

[58] Field of Search ..... 430/106, 106.6

[56] References Cited

U.S. PATENT DOCUMENTS 4,070,577 1/1978 Lewis et al. ..... 430/106 X
4,238,562 12/1980 Ishida et al. ..... 430/106
4,443,527 4/1984 Heikens et al. ..... 430/106 X
4,486,523 12/1984 Hosfeld et al. ..... 430/106.6

FOREIGN PATENT DOCUMENTS 51-42539 4/1976 Japan ..... 430/106
57-66441 2/1982 Japan ..... 430/106

*Primary Examiner*—Roland E. Martin
*Attorney, Agent, or Firm*—Reed Smith Shaw & McClay

[57] ABSTRACT

A colored magnetically attractable toner powder in which the individual toner particles comprise a core containing magnetically attractable material, a light-reflecting layer which envelops the core and comprises light-reflecting pigment, yellow-fluorescent dye and a binder in which the dye fluoresces, and a coloring layer which covers the light-reflecting layer and comprises yellow-fluorescent dye, optionally in an admixture with other fluorescent dye or dyes or pigments, and a binder in which the fluorescent dye or dyes fluoresce(s).

8 Claims, No Drawings

MAGNETICALLY ATTRACTABLE COLOR TONER POWDER

FIELD OF THE INVENTION

The present invention relates to magnetically attractable toner powder, and in particular, to magnetically attractable color toner having enhanced brightness and color saturation.

BACKGROUND OF THE INVENTION

Colored toner powders have been disclosed in the prior art, e.g., European patent application No. 0075346 assigned to the assignee of the present invention and incorporated herein by reference. The toner particles have a core comprising a magnetically attractable material such as iron, nickel, chromium dioxide, gamma ferrioxide and ferrites as well as combinations thereof, and the like, in amounts of from 10 to 90% by weight; and, a binder made from known materials such as polystyrene, polyvinyl chloride, polyacrylate, epoxy resins, and the like. The masking or light-reflective layer enveloping the core includes a binder and one or more reflecting color pigments such as lead chromate, lead molybdates and cadmium sulfide pigments or organic pigments coated on inorganic pigments such as segnale light yellow T3G. The final color to the toner is applied by "dyeing" in which the dye is applied directly in or on the masking layer or formed as a separate outer layer.

While the toners described in the above application provide suitable color renditions, they have the disadvantage that their brightness, and in some cases their color saturation, is relatively low. This disadvantage is found particularly with powders in yellow, green, orange and red color shades. It is, therefore, an object of the present invention to provide colored magnetically attractable toner powders which are distinguished from known toner powders by their brightness and color saturation.

SUMMARY OF THE INVENTION

Generally, the present invention provides a color toner in which each of the light-reflecting layer and the outer coloring layer contains a yellow-fluorescent dye and the binder in each layer consists of a polymer in which the yellow-fluorescent dye fluoresces. As used herein, the term yellow-fluorescent dye means a dye which absorbs light in the wavelengths up to 470 nm and radiates absorbed energy in the form of light in the wavelengths between about 500 nm and 560 nm.

It has been found that by including yellow-fluorescent dye in the light-reflecting layer, in addition to light-reflecting pigment, and in the coloring layer, and by forming both of these layers from a polymer in which the dye fluoresces, the amount of light reflected from the layer is substantially increased so that the brightness of the toner powder is greatly improved while at the same time maintaining good color saturation. This is contrasted to the electrophoretic fluorescent particles disclosed in U.S. Pat. No. 4,070,577, in which a core of fluorescent material is coated with a conventional electrophoretic charge coating.

According to the present invention, bright colored toner powders can be obtained in practically any color shade varying between yellow, green, orange and red. Toner powders in green, orange or red spectrum are obtained by including in the coloring layer with the yellow-fluorescent dye a green, or cyan pigment or one or more orange or red fluorescent dyes, respectively. The advantages of the present invention will become apparent from a perusal of the following detailed description of the presently preferred embodiments of the invention taken in connection with specific examples of toners in accordance with the invention.

PREFERRED EMBODIMENTS

The present invention provides magnetically attractable colored toners having enhanced brightness and color saturation. The invention incorporates within the light-reflecting layer and the coloring layer a yellow-fluorescent dye and polymer binder in which it fluoresces.

Examples of yellow-fluorescent dyes which are useful in the present invention are: Astrazon yellow 3GL (Cl No. 48055), Sandocryl Brilliant Yellow B10G (Basic Yellow 40), Maxillon Brilliant Flavine 10GFF (Basic Yellow 40), Acridine yellow (Cl No. 46025), Brilliant phosphine 5G (Cl No. 46035) and Brilliant Yellow 6G (Solvent Yellow 44).

The amount of yellow-fluorescent dye added to the light-reflecting layer must be high enough to provide a maximum light emission in the wavelength range between 500 and 560 nm. Typically, the layer should usually contain 2 to 10% by weight of yellow-fluorescent dye calculated with respect to the quantity of polymer binder present therein. In most cases, the preferred amount of yellow-fluorescent dye is between about 2.5 and 8% by weight. The preferred amount is determined by dissolving the dye in different percentages by weight in a melt of the polymer to be used, dispersing the amount of light-reflecting pigment required in the melt and, after cooling the melt, measuring the reflection of the different mixtures spectrophotometrically, such as by ICS Micro-Match Spectrometer equipped with the standard D65 light source.

The binder selected for the light-reflecting layer is preferably a thermoplastic polymer in which the yellow-fluorescent dye fluoresces. In particular, the polymer selected should be based upon providing optimum fluorescence suitable for the specific dye used. It has been found that polymers bearing one or more electronegative groups in their molecular structure, e.g., carbonyl, carboxyl, ester and epoxide groups, usually provide desirable fluorescent combinations with the commercially available fluorescent dyes. The addition to the polymer of a small percentage by weight (usually not more than 2 to 5%) of a compound bearing electronegative groups, such as an acid anhydride, e.g., maleic acid anhydride, phthalic acid anhydride and succinic acid anhydride, or an acid, such as benzoic acid, phthalic acid and succinic acid, appears to intensify the fluorescence of the dye in many cases. In the case of polymers bearing reactive groups, the fluorescence of the dye can frequently be improved by converting the reactive groups, or some of them, with a compound bearing electronegative groups, such as the aforementioned compounds. If a bifunctional or polyfunctional reagent is used for this conversion, the reaction can involve extension or cross-linking of the polymer chains. In that case, the reaction is so performed, by a correct selection of the initial polymer (chain length, reactive group content) and of the amount of bifunctional or polyfunctional reagent, that the binder finally obtained meets the requirements which have to be demanded upon it in respect of, e.g., visco-elastic behavior and situation of the glass transition temperature.

In addition to the requirement that the yellow-fluorescent dye fluoresce within the binder, it must also function to fix images. Examples of suitable binders are those now known in the art: polyesters, polycarbonates, polyacrylates and polymethacrylates, polyvinyl cloride and epoxy resins. Preferred binders include those derived from relatively low molecular epoxy resins and obtained by partly blocking the epoxide groups of the resins with a monofunctional reagent, e.g., p-cumylphenol, and partly cross-linking them by intermolecular reaction and/or reaction with a bifunctional or polyfunctional reagent bearing electronegative groups, e.g., one of the acid anhydrides mentioned above. If the partial cross-linking of the resin is obtained solely by intermolecular reaction, then a small quantity, e.g., about 2% by weight, of a compound bearing electronegative groups can advantageously be added to the binder so that the fluorescence of the dye is intensified. Examples of suitable binders derived from epoxy resins are described in United Kingdom Pat. Nos. 2,007,382; 2,014,325 and 2,036,353.

The light-reflecting pigment in the light-reflecting layer is preferably a white pigment, such as zinc oxide, antimony oxide zirconium oxide and titanium dioxide. Titanium dioxide in the anatase or rutile form is preferred because of its high refractive index. The particle size of the pigment is preferably only a few tenths of a micrometer, preferably about 0.2 micrometer. The white pigment content of the light-reflecting layer is 40 to 80% by weight, preferably about 60% by weight.

The coloring layer surrounding the light-reflecting layer of the toner powder according to the invention contains at least yellow-fluorescent dye which may be the same as present in the light-reflecting layer and preferably thermoplastic binder, which is preferably also the same as that of the light-reflecting layer.

In addition to the yellow-fluorescent dye, other coloring substances, which are selected in dependence on the color shade required for the toner powder, can be included in the coloring layer. If a yellow-colored toner powder is required, a yellow pigment and/or yellow dye can be included in the coloring layer. To obtain a green-colored toner powder, a green, preferably cyan pigment is included in the coloring layer. By varying the proportion between the yellow-fluorescent dye and the green or cyan pigment it is possible to vary the color shade of the toner powder between yellow-green and green.

According to one particular embodiment of the invention, orange and red colored toner powders are obtained by including in the coloring layer one or more orange and/or fluorescent dyes in addition to the yellow-fluorescent dye. An orange-colored toner powder is obtained by including in the coloring layer fluorescent dye which has high absorption in the fluorescence range of the yellow-fluorescent dye and fluoresces in the wavelength range of about 550 to 600 nm.

A red-colored toner powder is obtained by adding to the latter composition fluorescent dye having absorption in the range of about 550 to 600 nm and fluorescing in the range from about 600 nm. Red-colored toner powder can also be obtained by including in the coloring layer, in addition to yellow-fluorescent dye, solely red-fluorescent dye, i.e., dye which has absorption in the wavelength range up to about 600 nm and fluoresces in the range above about 600 nm.

Toner powders in different color shades can be obtained by varying the initial dyes and initial pigments and the proportions by weight of those substances in the color layer. Toner powders with pastel shades can also be obtained by including in the coloring layer a quantity of white pigment, such as titanium dioxide, in addition to the coloring substance indicated above.

Examples of pigments and fluorescent dyes which, in combination with the yellow-fluorescent dye, can be used in the coloring layer are: chrome green, Pigment green B (PB8), Flexo Red 540, Rhodamine F5GL (Cl No. 45160), Rhodamine 6GDN extra, (Cl No. 45160), Rhodaminebase FB (Cl No. 45170), Rhodamine BNS (Cl No. 45170:1), Rhodamine F4GK, Rhodamine B extra (Cl No. 45170), Astra Phloxine G, (Cl No. 48070), Acridine G (Cl No. 46025), Panacryl Brilliant Reb B, and Brilliant Acridine Orange ES.

If an orange or red colored toner powder is required, a small quantity of orange or red fluorescent dye can if required already be included in the composition for forming the light-reflecting layer.

According to the present invention, the coloring layer needs only a relatively small quantity of coloring substances to produce bright colored toner powder with a high degree of color saturation. The coloring substances content of the coloring layer need usually not be more than 10% by weight based on the quantity of binder. The advantages of the fact that only a relatively small quantity of coloring substances is required is that the visco-elastic properties of the binder used in the coloring layer are not, or practically not, influenced by the coloring substances added thereto. The selection of a binder suitable for a specific use of the toner powder is thus facilitated, because that selection can be made without consideration for any change of visco-elastic properties as a result of the additives to be used with the binder.

Toner powder according to the invention is obtained by enveloping a magnetically attractable core successively with the light-reflecting layer and with the coloring layer. The two layers can be formed by the so-called "granulate method" as described in European patent application No. 0075346, incorporated by reference herein. According to the granulate method, a fine granulate consisting of particles of not more than 3 μm, and preferably 1 to 3 μm, which contain binder, yellow-fluorescent dye and other constituents to be accommodated in the layer to be formed (e.g., reflecting pigment and/or coloring substances) are dispersed together with magnetically attractable cores (or, if the coloring layer is applied, together with cores provided with a reflecting layer) in a liquid in which the binder of the granulate and/or that of the particles to be enveloped softens, but does not dissolve, and the dispersion is stirred or otherwise agitated at room temperature or slightly elevated temperature until the cores are completely enveloped by the granulate. The liquid in which the granulate together with the particles to be enveloped is dispersed and stirred is selected according to the type of binder present in the granulate and/or the particles to be enveloped. For example, it may consist of an organic solvent or a mixture of water with one or more water-miscible organic solvents. The granulate is prepared in the known manner; that is, by melting the binder, adding the yellow-fluorescent dye and other additives to the melt, and dissolving and finely distributing them therein respectively. Thereafter the melt is cooled to a solid mass ground into particles of a size between 1 and 3 μm.

The magnetically attractable core of the toner particles according to the invention may consist of one single magnetically attractable particle or of binder containing magnetically attractable particles. The magnetically attractable particles may consist of materials known for use in magnetically attractable toner powder, or of mixtures thereof, including e.g., iron, nickel, chromium dioxide, gamma-ferrioxide and ferrites of the formula $MFe_2O_4$, in which M represents a bivalent metal e.g., iron, manganese, nickel or cobalt, or a mixture of metals of other valency. Other examples are the rare-earth iron garnets having the formula $R_3Fe_5O_{12}$, in which R denotes a rare-earth or other trivalent ion such as yttrium or scandium. The iron in these garnets can also be partially replaced by other ions. It is an advantage of the toner powders of the present invention that the choice of magnetically attractable material is independent of its color.

The binder used in the magnetically attractable core may be selected from the group of polymers known for their use in toners. Examples of such polymers are polystyrene, polyvinyl chloride, polyacrylates and polymethacrylates, polyester resins, polyamides and epoxy resins. Modified epoxy resins, such as indicated herebefore, can also be used as the core binder. The content of the magnetically attractable material in a core consisting of a binder and magnetically attractable particles may be between 10 to 90% by weight, depending upon the magnetic properties of the selected magnetically attractable material and upon the use for which the toner powder is intended. This content is generally between 40 and 80% by weight.

The size of the magnetically attractable core is within the order of approximately 5–50 μm conventional for toner powders and is preferably about 8–20 μm. If the core consists of a binder and magnetically attractable particles, the particle size of the magnetically attractable particles is generally between 1 and 30 μm.

The present invention will be explained in detail by reference to the following example.

ILLUSTRATIVE EXAMPLE

A. Preparation of the Magnetically Attractable Cores 80 g of epoxy resin (Epikote 1004 from Shell (Netherlands) were melted and kept at a temperature between 100° an 130° C. 700 g of carbonyl iron (Type HF2 from B.A.S.F.—(Germany) were homogeneously distributed in the melt. After the melt had been cooled to room temperature and solidified, it was ground into particles having a particle size of between 9 and 35 μm which were separated by screening. The particles were sprayed in a stream of hot air having a temperature of about 500° C. and then recooled to room temperature. Spherical magnetically attractable cores were obtained in this way, consisting of carbonyl iron particles completely enveloped with epoxy resin.

B. Preparation of Granulates for Applying the Light-Reflecting Layer 1. 365 g of epoxy resin (Epikote 1001 of Shell (Netherlands) were melted and kept at a temperature of about 130° C. The following were added to the melt with continuous mixing:
600 g of titanium dioxide
10 g of maleic anhydride
25 g of Maxillon Brilliant Flavine 10 GFF (yellow-fluorescent dye)

The melt was intensively mixed at about 130° C. until a homogeneous mass was obtained. This mass was cooled to room temperature and solidified. The solid mass was then ground into particles having a size of between 1 and 3 μm. A yellow-green colored granulate was obtained.

2. The method described in step B(1) was repeated using the following raw materials:
360 g of polyester resin (Atlac T 500 of Atlas Chemical Industries N.V., Belgium)
12 g of phthalic anhydride
600 g of titanium dioxide
28 g of Sandocryl Brilliant Yellow B10G (yellow-fluorescent dye)

A yellow-green colored granulate was obtained.

3. The method described in step B(1) was repeated using the following raw materials:
362 g of epoxy resin (Epikote 1001 of Shell (Netherlands)
11 g of maleic anhydride
600 g of titanium dioxide
21 g of Maxillon Brilliant Flavine 10 GFF
6 g of Rhodamine F5GL A pink-colored granulate was obtained.

C. Preparation of Granulates for Applying a Coloring Layer

1. Preparation of a yellow granulate
91 g of modified epoxy resin, prepared as described hereinafter, were melted and
2.7 g of maleic anhydride
6.4 g of Maxillon Brilliant Flavine 10 GFF (yellow-fluorescent dye)

were added to the melt. The melt was mixed until a homogeneous mass was obtained. After cooling the solid mass was ground into particles of a size between 1 and 3 μm.

The modified epoxy resin was prepared as follows:
45 g of epoxy resin (Epikote 828 of Shell (Netherlands)
180 g of epoxy resin (Epikote 1004 of Shell (Netherlands) and
75 g of p-cumylphenol were heated to 130° C. and 150 g of triethylamine was gradually added to the melt while stirring continuously. After all the triethylamine had been added the mixture was again stirred for about 2 hours at about 160° C., and then cooled to room temperature.

2. Preparation of a green granulate

The method described in step C(1) was repeated using the following raw materials:
86.6 g of modified epoxy resin
2.3 g of maleic anhydride
5.6 g of Sandocryl Brilliant Yellow B10G (yellow-fluorescent dye)
4.2 g of Monostral Fast Green 6Y (cyan pigment)

3. Preparation of a red granulate

The method described in step C(1) was repeated using the following raw materials:
91 g of epoxy resin (Epikote 1001 of Shell (Netherlands)
2.7 g of maleic anhydride
4.5 g of Maxillon Brilliant Flavine 10 GFF (yellow-fluorescent dye)
1.1 g of Rhodamine F5GL (orange-red fluorescent dye)
0.5 g Flexo-red 540 (red-fluorescent dye)

4. Preparation of an orange-red granulate

The method described in Step C(1) was repeated using the following raw materials:

88 g of polyester resin (Atlac T500 of Atlas Chemical Industries, N.V., Belgium)
5.9 g of phthalic anhydride
5 g of Astrazon yellow 3GL
1.1 g of Rhodamine base FB D. Application of the light-reflecting layer and of the coloring layer A light-reflecting layer was applied to the magnetic cores prepared above by dispersing 25 g of cores together with 25 g of granulate prepared in accordance with step B(1), B(2) or B(3), in 150 ml of an ethanol-water mixture (±25% volume ethanol) and rotating the dispersion for about 10 hours at 25° C. in a ball mill. The particles provided with a light-reflecting layer were then separated from the dispersion and dried. The coloring layer was applied in the same way as the light-reflecting layer to particles provided with a light-reflecting layer, but in this case use was made of 50 g of the particles provided with a light-reflecting layer per 25 g of granulate prepared according to step C(1), C(2), C(3) or C(4).

Yellow-colored toner powder was obtained by providing magnetically attractable cores with a light-reflecting layer using granulate according to step B(1) and then with a coloring layer by means of granulate according to step C(1).

The following color specifications of the toner powder were measured (in CIELAB notation) in an ICS micro-match spectrometer equipped with standard light source C: L=60.05, C=66.6, $H^o$=88.9.

Orange-colored toner powder was obtained by coating the magnetically attractable cores successively with the granulates according to steps B(2) and C(4). The color specifications of the resulting brightly colored toner powder were L=49.15, C=60.11, $H^o$=40.38.

Red-colored toner powder was obtained by coating the magnetically attractable cores successively with the granulates according to steps B(3) and C(3). The color specifications of the toner powder were L=46.7, C=66.6, $H^o$=36.4.

Green-colored toner powder was obtained by coating the magnetically attractable cores successively with the granulates according to steps B(1) and C(2). The color specifications of the toner powder were L=55.87, C=73.5, $H^o$=140.4.

With all the toner powders it was possible to make brilliantly colored copies of good quality.

While presently preferred embodiments of the invention have been described and illustrated in particularity, the invention may be otherwise embodied within the scope of the appended claims.

What is claimed is:

1. In colored magnetically attractable toner powder, the individual particles of which comprise a core containing magnetically attractable material, a light-reflecting layer enveloping said core containing a binder and light-reflecting pigment, and a coloring layer covering said light-reflecting layer and containing a binder and non-yellow fluorescent dye, the improvement comprising in combination therewith a yellow-fluorescent dye added to said light-reflecting layer in an amount up to 10% by weight of the binder to obtain maximum light-reflection in the wavelength between 500 to 560 nm and to the coloring layer wherein said binder in both of said layers consists of a polymer in which said yellow-fluorescent dye fluoresces.

2. A toner powder according to claim 1, wherein the content of said yellow-fluorescent dye in the light-reflecting layer is about 2.5 to 8.0 by weight based on the quantity of binder in said layer.

3. A toner powder according to claims 1 or 2, wherein said coloring layer also contains cyan pigment.

4. A toner powder according to claims 1 or 2, wherein the coloring layer also contains at least one other fluorescent dye which absorbs light in the fluorescence range of the yellow-fluorescent dye.

5. A toner powder according to claims 1 or 2, wherein said binder in both layers is a polymer bearing electronegative groups.

6. A toner powder according to claims 1 or 2, wherein each of said layers additionally contains a compound having at least one electronegative group.

7. A toner powder according to claim 6, wherein said compound bearing at least one electronegative group is an acid anhydride.

8. A toner powder according to claim 6, wherein the binder is epoxy resin, the epoxide groups of which have been partly blocked by a monofunctional reagent and partly cross-linked by intermolecular reaction and/or reaction with a bifunctional or polyfunctional reagent bearing electronegative groups.

* * * * *